US007367453B2

(12) United States Patent
Sutherland

(10) Patent No.: US 7,367,453 B2
(45) Date of Patent: May 6, 2008

(54) CAN DISPENSING PACKAGE

(75) Inventor: Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 111 days.

(21) Appl. No.: 11/199,401

(22) Filed: Aug. 8, 2005

(65) Prior Publication Data

US 2006/0000881 A1 Jan. 5, 2006

Related U.S. Application Data

(63) Continuation of application No. 10/402,879, filed on Mar. 28, 2003, now Pat. No. 6,997,316.

(51) Int. Cl.
*B65D 75/00* (2006.01)
*A47F 1/04* (2006.01)

(52) U.S. Cl. ..... 206/427; 221/305

(58) Field of Classification Search ..... 206/427, 206/430, 434; 229/117.13, 122–122.1, 240–242; 221/303, 305, 302
See application file for complete search history.

(56) References Cited

U.S. PATENT DOCUMENTS 2,899,123 A * 8/1959 Currie, Jr. ..... 206/427
3,356,279 A 12/1967 Root
3,578,238 A * 5/1971 Schillinger et al. ..... 206/427
4,396,143 A 8/1983 Killy
4,785,991 A 11/1988 Schuster
5,249,681 A * 10/1993 Miller ..... 206/427
5,368,194 A 11/1994 Oliff et al.
5,558,224 A * 9/1996 Fogle ..... 206/427
5,622,309 A 4/1997 Matsuda
D389,739 S * 1/1998 Auclair ..... D9/433
5,772,030 A * 6/1998 Baxter ..... 206/427
6,105,774 A * 8/2000 Jackson ..... 206/434
6,283,293 B1 9/2001 Lingamfelter
D459,927 S 7/2002 Flowers
6,484,903 B2 11/2002 Spivey
6,550,615 B2 4/2003 Lingamfelter
6,578,736 B2 6/2003 Spivey
6,669,083 B2 12/2003 Bates
6,715,639 B2 4/2004 Spivey
6,789,673 B2 9/2004 Lingamfelter
7,000,803 B2 * 2/2006 Miller ..... 221/302
2002/0029991 A1 3/2002 Lingamfelter
2002/0070139 A1 6/2002 Bates
2002/0185499 A1 12/2002 Harrelson
2003/0141313 A1 7/2003 Bates
2004/0089575 A1 5/2004 Lingamfelter (Continued)

*Primary Examiner*—Bryon P. Gehman
(74) *Attorney, Agent, or Firm*—Womble Carlyle Sandridge & Rice, PLLC

(57) ABSTRACT

The carton is provided for carrying cylindrical containers, such as cans in three or more layers and having open ends at the top and bottom of each end of the carton. A dispenser flap is formed by zigzag tear lines in the exiting end of the carton. The carton is constructed so that the ends of a can adjacent the exiting end of the carton are exposed and can be grasped by a person pulling the can forward or up and commencing the tear line forming the flap. Preferable this tear line is of a zigzag configuration, or step format with interruptions in the riser. Cut tear lines in the step permit the controlled tearing of the tear line.

38 Claims, 4 Drawing Sheets

U.S. PATENT DOCUMENTS

2004/0099558 A1 5/2004 Oliff
2004/0155098 A1 8/2004 Harrelson
2004/0188300 A1 9/2004 Sutherland
2005/0023170 A1 2/2005 Lingamfelter

* cited by examiner

CAN DISPENSING PACKAGE

CROSS-REFERENCE TO RELATED APPLICATIONS

This application is a continuation of U.S. patent application Ser. No. 10/402,879 filed Mar. 28, 2003, now U.S. Pat. No. 6,997,316, which is incorporated hereby by reference in its entirety.

BACKGROUND OF THE INVENTION

1. Field of the Invention

The present invention relates generally to a partially enclosed paperboard carton capable of enclosing cylindrical containers, such as cans, which carton has a unique dispensing feature that allows the containers to be utilized as an opening device for the dispenser and permits the containers to be rolled out of the carton without destroying the structural integrity of the carton.

2. Background

Fully enclosed cartons capable of enclosing cans have been used in the past that have a feature for dispensing the cans one at a time. Dispenser sections have been provided at various locations within these cartons depending upon the design. Many of these dispensers tend to let all of the containers roll out once they have been opened. Many of the cartons with dispensers are fully enclosed. It would be desirable to have a carton with a dispenser that provided some exposure of the containers inside for advertising purposes.

3. Prior Art

U.S. Pat. No. 3,265,283 to Farquhar discloses a fully enclosed carton having a dispenser for dispensing the enclosed cans. The end wall of the carton has a dispensing flap which can be folded down upon opening. An aperture formed by the flap extends into the side walls to permit grasping of the can to withdraw it from the carton. When the flap is opened, the cans are held in the carton by an arcuate flap portion extending downwardly in the end wall into the center of the aperture. The structural integrity of this carton is compromised because the entire bottom end of the carton is opened.

U.S. Pat. No. 4,364,509 to Holly Jr. et al. also discloses a fully enclosed carton with a dispenser in one of the end walls. This dispenser is likewise formed in the end wall by tearing out an end flap and lowering it into proper position.

Expansion slits are provided in the side wall for the user's fingers to grasp the ends of the existing can.

SUMMARY OF THE INVENTION

It is an object of this invention to develop a dispenser for dispensing cylindrical containers, such as cans, one at a time from a carton containing three or more layers of containers. It is a further object of this invention to develop a dispenser that can be easily opened, but provide some resistance to being completely torn open allowing all of the containers to roll out. It is a further object to develop a dispenser for a carton that has openings to allow the consumer to view some of the containers and the printed material on them through one or more openings. Another object of this invention is to develop a dispenser which is easy to commence opening, but would provide some resistance to further tearing.

Briefly described, in its preferred form, the objects of this invention are achieved by providing a carton for carrying cylindrical containers in at least three layers for dispensing the containers one at a time from the exiting end of the carton. The carton is generally rectangular and has a bottom, top, two side panels, a closed end and an exiting end. The carton is foldably constructed from a blank having panels and flaps. The exiting end of the carton is preferable closed by two end flaps, each of which is attached to a side panel. An opening is provided between the top of the two end flaps when they are closed and the top panel. This opening must be significantly smaller than the containers contained to prevent them from falling out of the carton. An arcuate opening is provided in each side panel adjacent the exiting end of the carton and the top panel. It is preferred that the side panels extend beyond the ends of the top and bottom panels.

A tear line is provided that extends from each arcuate opening in each side panel adjacent the exiting end and the top panel, with these tear lines converging towards each other and extending towards the bottom panel so as to form a dispensing flap that may be opened for dispensing the cylindrical containers one at a time.

A new and unique method of opening this dispenser is provided in that when the carton is loaded with cans the ends of one can will be aligned between the arcuate openings in each side panel adjacent the exiting end of the carton and the top panel.

A person can start the tearing of the tear lines forming the dispensing flap by simply grasping the ends of the container between the arcuate openings in each side panel and pulling the container forward and upward which commences tearing of the tear lines.

In its preferred form, these tear lines have a zigzag configuration with interspersed interruptions in at least a portion of each tear line so that the tear lines resist tearing under the normal stresses imposed on a carton loaded with containers. Each zigzag tear line is similar to a set of stairs composed of sets of a step and a riser with the interruption in the riser and the clean cut line in the step.

These converging tear lines may turn and extend as a regular tear line or a tear line with perforations to a bottom fold line so that the dispenser flap when fully opened can be folded along the fold line and placed adjacent to the bottom portion of the exiting end of the carton. This bottom fold line of the dispenser flap is preferable placed at a location between 115 and 150 percent of the diameter of a container to be contained in the carton.

This carton may have a bottom opening between the bottom of the end flaps when they are closed and the bottom panel with an adjacent arcuate opening on each side panel to make the containers in the carton more visible. The non-exiting end of the carton is preferable closed by end flaps, and preferable has a top and bottom opening and adjacent arcuate openings in each side panel similar to or identical to the top and bottom openings and arcuate openings in the exiting end of the carton. These openings also serve the purpose of reducing the amount of paperboard used to construct the carton.

As many beverage cans frequently have a bottom end of a slightly different shape and size than the top end, two parallel fold lines may be provided between the end flaps and side panels against which the bottoms of the cans are adjacent to facilitate folding the end flaps attached to this side panel.

This carton may have a handle formed in the top panel. It is preferable that a slotted handle formed by two flaps with a slit in between that extends across the top panel and into the side walls be used.

These and other objects, features, and advantages of the present invention will become more apparent upon reading the following specification in conjunction with the accompanying drawing figures.

DETAILED DESCRIPTION OF THE PREFERRED EMBODIMENT

The present invention is intended primarily for use with cans, and other types of cylindrical containers, used to contain soft drinks, beer and the like.

Figure 1:
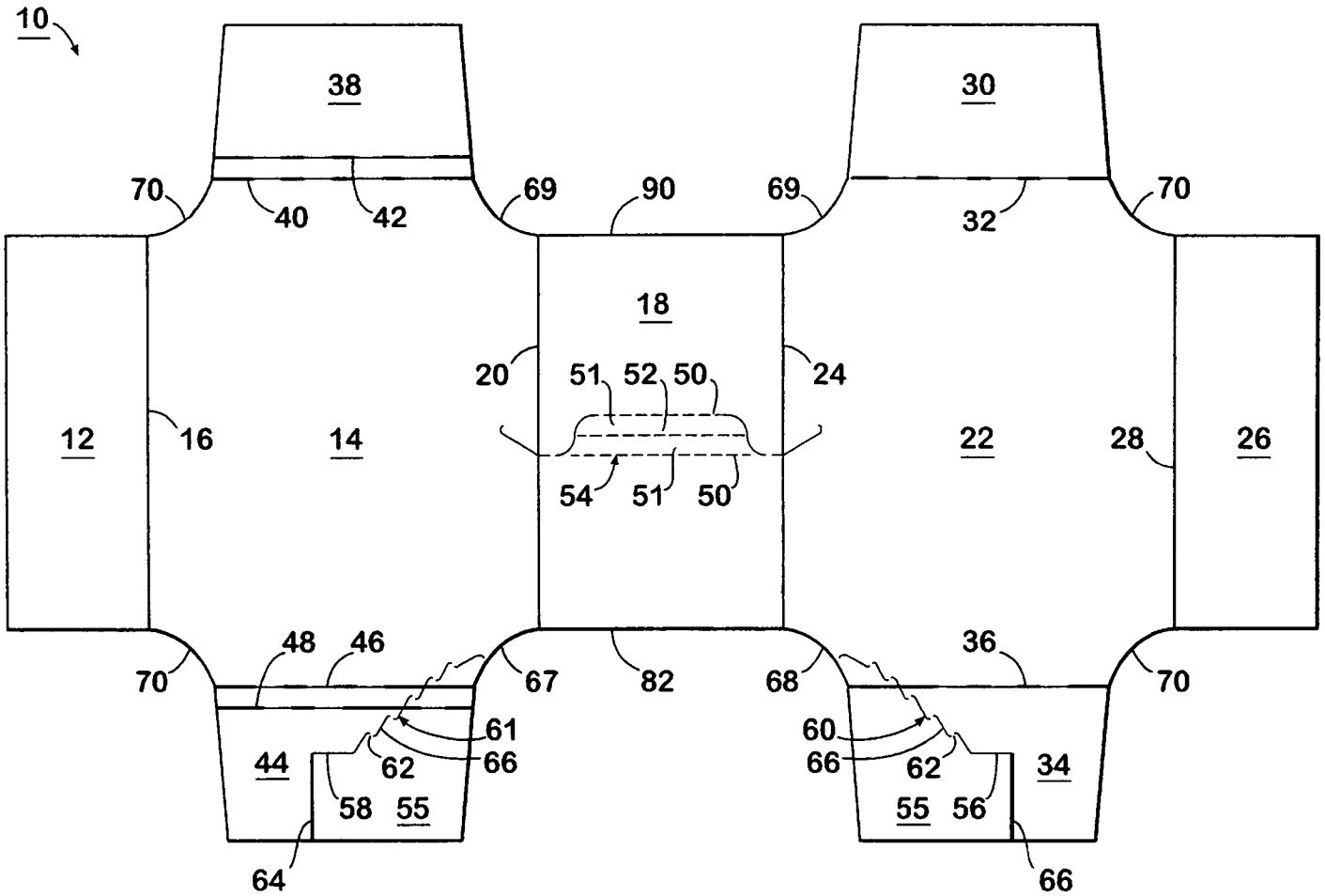
FIG. 1. is a plan view of a blank from which a carton of one embodiment of the invention is formed.

According to a preferred embodiment of the invention, the cans are packaged in a carton that is fully enclosed, except for openings in both ends at the top and bottom. The blank for forming this carton is illustrated in FIG. 1. The blank 10 is formed from a foldable sheet of material, such as paperboard. The blank 10 has a bottom flap 12 that is foldable connected to a bottom side panel 14 by fold line 16, and in turn connected to top panel 18 by fold line 20. The top panel 18 is connected to top side panel 22 by fold line 24, which in turn is connected to bottom flap 26 by fold line 28.

The blank 10 has a top side panel 22 that is connected to end flap 30 by fold line 32, and in turn connected to exiting end flap 34 by fold line 36. Bottom side panel 14 is connected to end flap 38 by fold lines 40 and 42, and in turn connected to exiting end flap 44 by fold lines 46 and 48. A slotted handle 54 is formed in top panel 18 by fold lines 50 which forms two handle flaps 51 which are separated by a handle tear line 52 which may be extended into bottom side panel 14 and top side panel 22 to dissipate the stress imposed in carrying the carton by the slotted handle 54.

Exiting end flaps 34 and 44 have a dispenser flap 55 which is connected to the rest of the carton by tear lines 56 and 58, which may be complete tear lines or perforated tear lines. Zigzag tear line 60 extends from the curved end edge 68 of the top side panel 22 until the zigzag tear line 60 reaches tear line 56. Zigzag tear line 61 extends from the curved end edge 67 of bottom side panel 14 until the zigzag tear line 61 reaches tear line 58. Zigzag tear lines 60 and 61 may have lands or interruptions 62, whose purpose will be explained below. The dispenser flap 55 may have fold lines 64 and 66 connecting it to exiting end flaps 44 and 34, respectively.

In the preferred embodiment of this invention there may be curved end edges 69 in the top of bottom side panel 14 and top side panel 22 adjacent end flaps 38 and 30. There also may be curved end edges 70 on each end of bottom side panel 14 and top side panel 22 adjacent to bottom flaps 12 and 26 respectively.

It will be understood by those skilled in the art that the carton of the present invention is generally symmetrical about a horizontal line of bi-section, as viewed when FIG. 1 is rotated lengthwise. This symmetry aids in the efficient production of the present carton.

Figure 2:
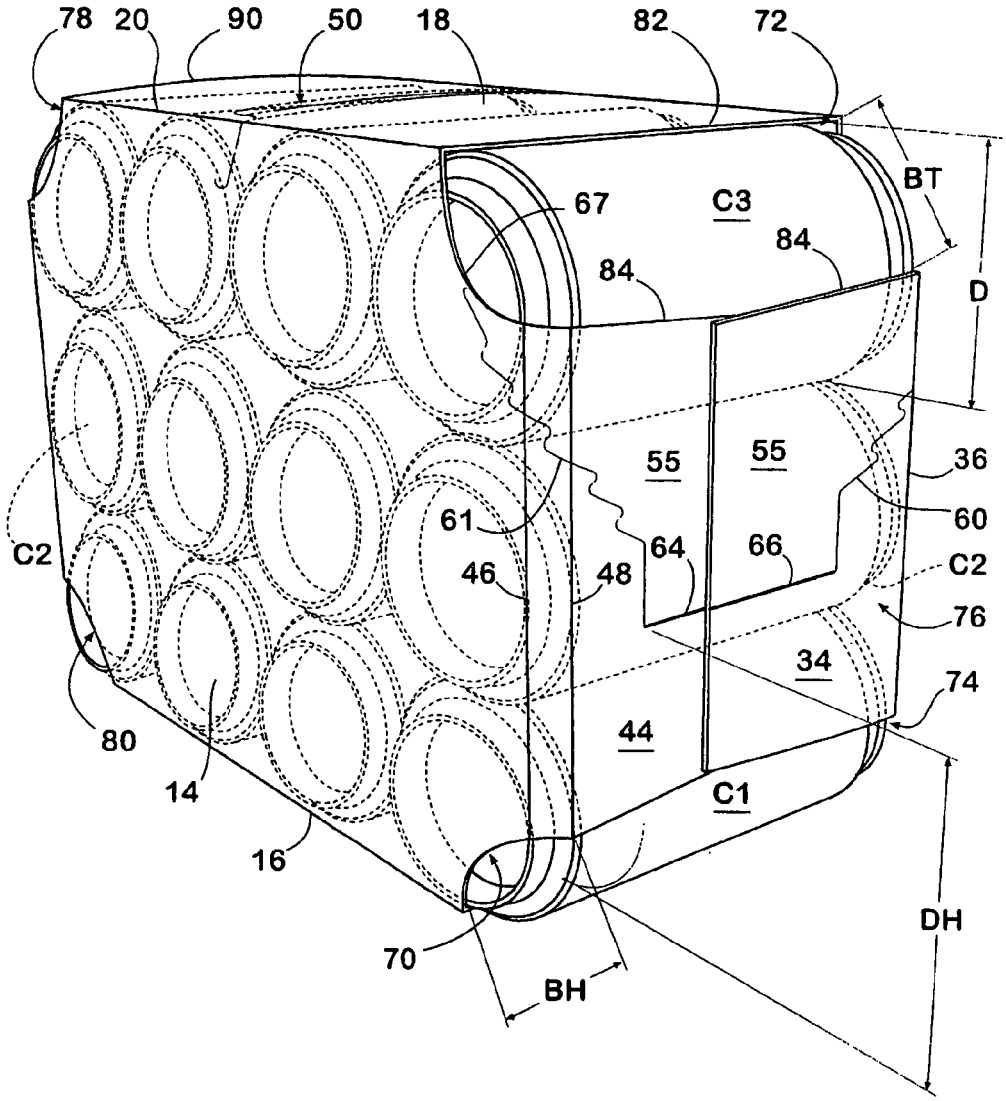
FIG. 2 is a perspective end view of a carton formed from the blank of FIG. 1 and loaded with cans.

In forming this blank 10 into a carton, the blank is folded along fold lines 16, 20, 24, and 28 and bottom flap 12 is glued to bottom flap 26 forming a carton sleeve. Cans C can then be loaded into the carton sleeve. This carton is designed to hold 12 cans, or other types of cylindrical containers, in three layers of four cans in each layer. It should be understood that a carton can be constructed utilizing the features of this invention that can carry more than four cans in each layer and have more than three layers. The cans C are inserted into the carton sleeve with the bottoms of the cans being adjacent to bottom side panel 14. The manner in which the cans C are contained in the carton formed from the blank of FIG. 1 is best illustrated in FIG. 2. Once the cans have been inserted end flaps 30 and 38 can be folded and glued together. Exiting end flaps 34 and 44 can be folded and glued together thus finishing the loading of the carton with cans C.

It will be noticed that there are two fold lines 40 and 42 between bottom side panel 14 and end flap 38 and two fold lines 46 and 48 between bottom side panel 14 and exiting end flap 44. Two fold lines on each end of bottom side panel 14 are preferred to accommodate the dimensions of the bottoms of the cans C. This facilitates the folding of end flap 38 and exiting end flap 44. However, it should be realized that a single fold line may also be used when appropriate, depending on the configuration of the bottom of the cans being placed in the carton.

This carton has a slotted handle 54, but it should be realized that this carton could be constructed without a handle or another type of handle may be used. While bottom flaps 12 and 26 are preferably glued together to form a carton sleeve, they could be joined together by mechanical locks that are known in the art.

It is preferred that there is a top opening 72 and bottom opening 74 on the exiting end 76 of the carton as shown in FIG. 2. An identical top opening 78 and bottom opening 80 may be provided on the non-exiting end of the carton. Top openings 72 and 78 must have a height that is significantly less than the diameter D of a can. The height BT between the front edge 82 of top panel 18 and the top edge 84 of exiting end flaps 34 and 44 must be significantly less than the diameter D of the cans contained in the carton. Preferable this aperture should have a height BT that permits the labeling and logos on the cans C to be visible. It is preferred that the distance BT be between approximately 40 and 70 percent of the diameter D of the cans C so that the cans do not fall out of the carton through top opening 72 when subjected to the normal stresses of carrying and handling the carton. The dimensions of the other openings 74, 78, and 80 are preferably the same as top opening 72.

Figure 4:
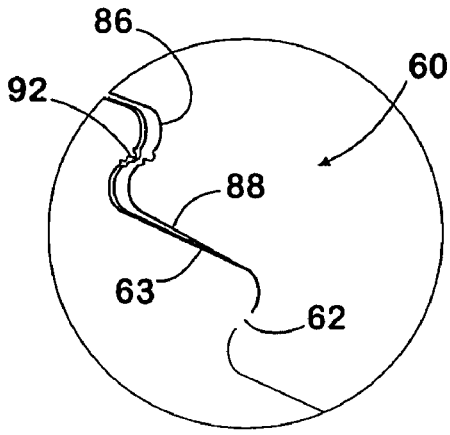
FIG. 4 is an enlarged view of a section of the tear line between the dispenser flap and the rest of the carton taken from FIG. 3.

A zigzag tear line 61 extends from curved edge 67 through bottom side panel 14 and into exiting end flap 44. A zigzag tear line 60 extends from curved edge 68 through top side panel 22 and into exiting end flap 34. While it is preferred to use zigzag tear lines 60 and 61, it should be realized that an ordinary tear line which may be straight with interruptions or lands in the tear line may be utilized. These zigzag tear lines 60 and 61 have a series of cuts 63 and interruptions or lands 62 to prevent the uncontrolled tearing of zigzag tear lines 60 and 61 when the dispenser flap 55 is being opened as shown in FIG. 4. Preferable these zigzag tear lines 60 and 61 are constructed in the format of stair steps which have a step 88 and a riser 86 as illustrated in FIG. 4. A land or interruption 62 may be formed in the riser 86 while a cut line 63 may be formed in the step 88. It is preferred that zigzag tear lines 60 and 61 turn into regular tear lines or perforated lines 56 or 58 until they reach fold line 64 or 66, as the case may be. While it is preferred that the dispenser flap 55 have fold lines 64 and 66, they may be omitted in some cases.

Figure 3:
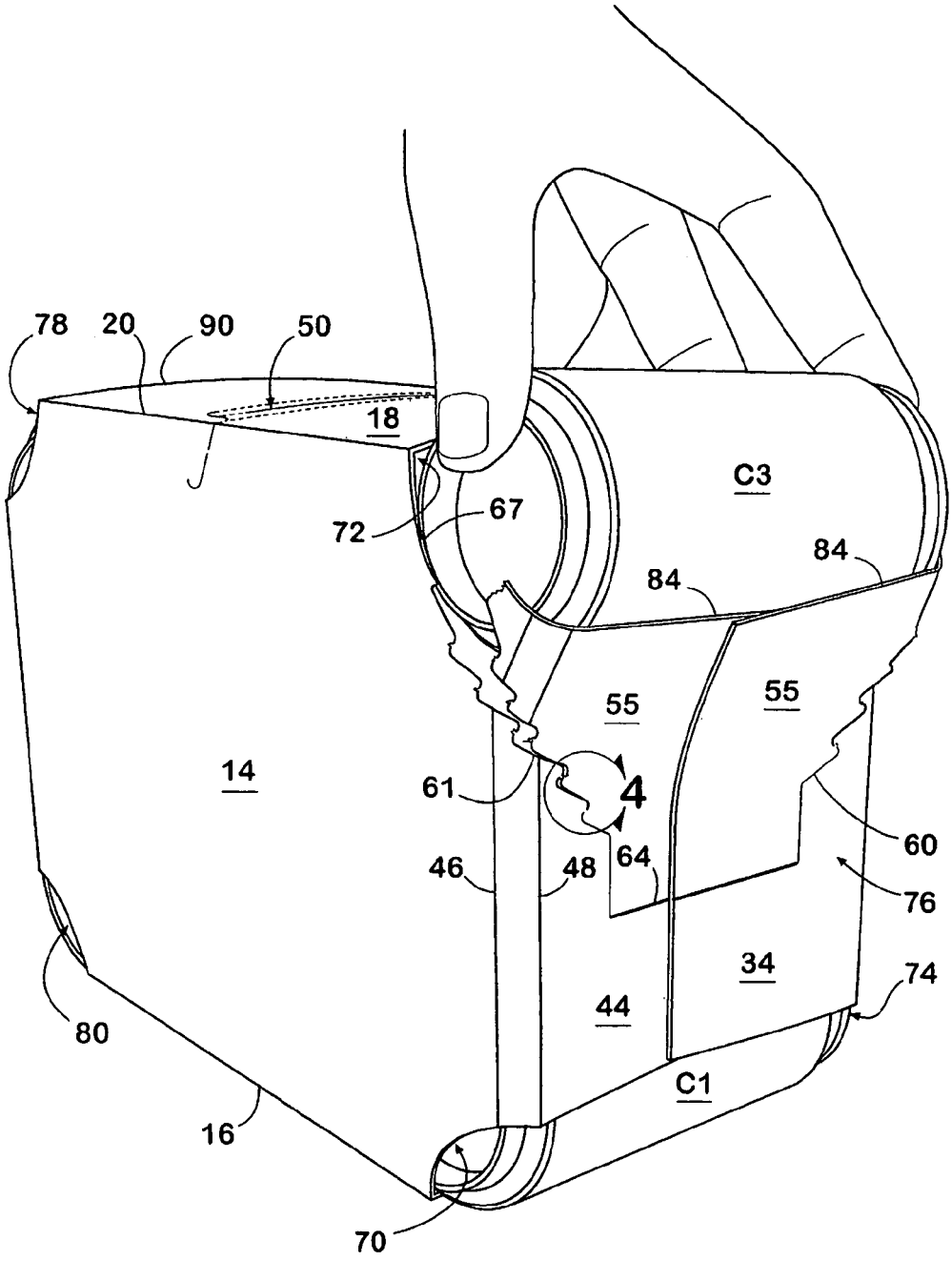
FIG. 3 is a perspective end view of the carton of FIG. 2 in which a person is commencing to remove a can and in the process of commencing tearing the tear lines which commences opening the dispenser flap.

A can C may be removed from the carton by a person grasping the ends of the can 63 and pulling the can upward or forward as illustrated in FIG. 3. The curved or arcuate edge 67 and 68 of bottom side panel 14 and top side panel 22 respectively, facilitate a person grasping the ends of the can C. In order to form these curved edges 67 and 68 and to provide a significant distance BT between the top edge 84 of exiting end flaps 34 and 44 and the edge of the top panel 82, it is preferred that the distance from the top edge 82 of the top panel 18 and the non-exiting edge 90 be significantly less than the distance between fold lines 40 and 46 in bottom side panel 14. The same relationship is also true between top side panel 22 and top panel 18.

When a person grasps the end of the can C3 as illustrated in FIG. 3 and pulls upward or forward, this motion serves the function of commencing the tearing of zigzag tear lines 60 and 61. The can C3 provides extra mass and leverage for commencing the tearing of the zigzag tear lines 60 and 61 which could be hard to tear by a person only grasping the dispenser flap 55 and attempting to tear it. The zigzag tear lines 60 and 61 with it risers 86 and steps 88 and lands or interruptions 62 provides some resistance to the uncontrolled tearing of lines 60 and 61. It is important that lands or interruptions 62 be placed at least in the zigzag tear lines 60 and 61 adjacent curved edges 67 and 68. The uncontrolled tearing of zigzag lines 60 and 61 and tear lines 56 or 58 could result in the complete severing of exiting end 76 allowing many of the cans to roll out of the carton at one time. After the can C3 on the top layer of cans has been removed, the dispenser flap 55 can be torn down to fold lines 64 and 66 so that it is positioned adjacent to bottom of the exiting end 76 of the carton. It should be realized that in the absence of fold lines 64 and 66, the dispenser flap 55 will have a tendency to naturally fold in the location of those tear lines.

It should be realized that the can C3 in the top layer of cans serves the function of an opening device which can be grasped by its ends and start opening the dispenser flap 55. Once the dispenser flap 55 is partially opened, a person can grasp the dispenser flap 55 and finish the desired tearing. While it is preferred that the lands or interruptions 62 be in the riser 86 and the cut line 63 be in the step 88 of the zigzag tear lines 60 and 61, the position of the cut 63 and land or interruption 62 could be reversed. It is preferred that the zigzag tear lines 60 and 61 be constructed to provide resistance to tearing during the normal handling and carrying of the carton filled with cans. The placing of the lands or interruption 62 and the cut lines 63 and the manner in which zigzag tear lines 60 and 61 are configured depends upon a number of factors, such as the caliber of the paperboard of which the carton is formed and the weight and size of the cans C and the handling and carrying conditions anticipated.

Figure 5:
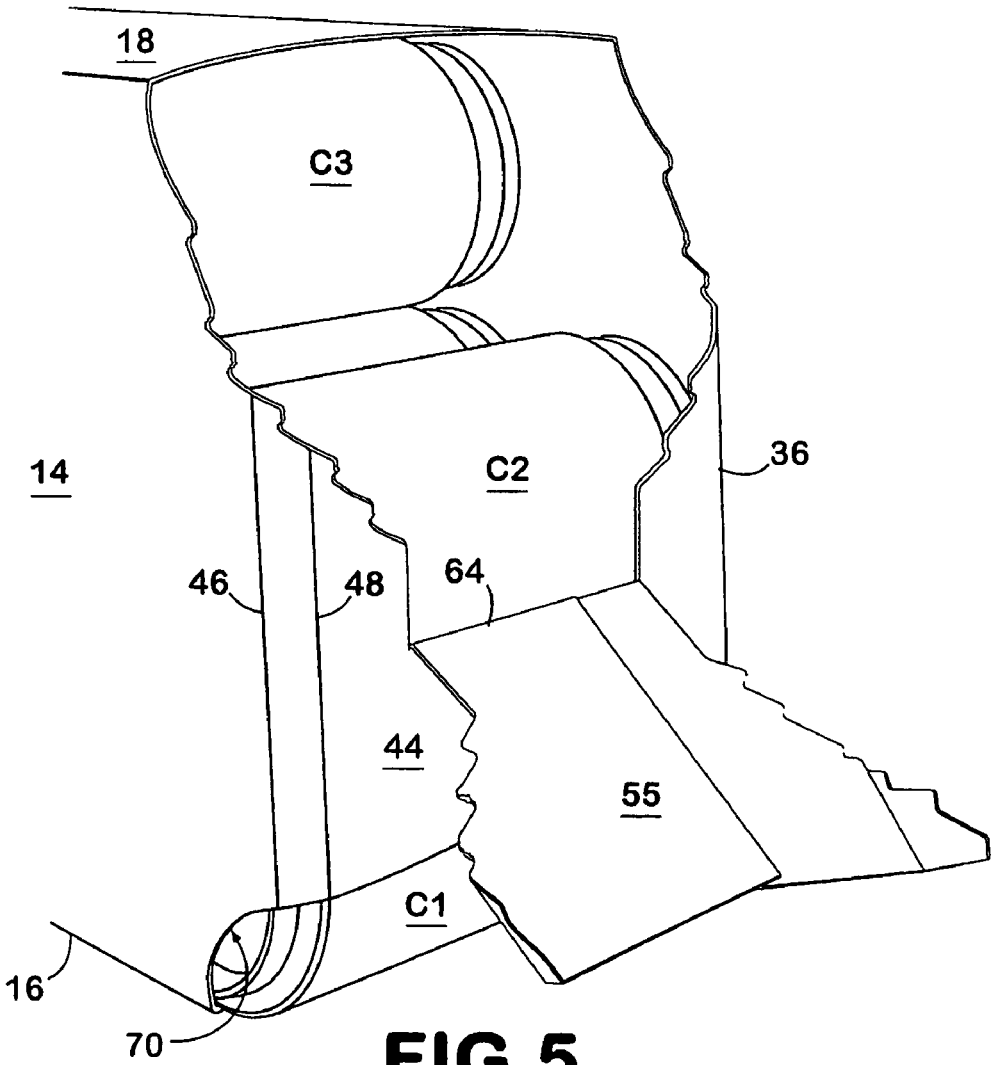
FIG. 5 is a perspective end view of the carton of FIG. 3 in which the can in the top layer has been removed and the dispenser flap torn open and folded downward along its bottom fold line.

The can C2 in the second row as illustrated in FIG. 5 can easily be removed by reaching into the carton and removing it. The can C1 in the bottom layer can be removed by reaching into the carton and removing the can or tilting the carton towards the exiting end 76 and letting it roll out of the opening formed by the removal of the dispenser flap 55.

This carton preferable has a bottom opening 74 and may have top opening 78 and bottom open 80 on the non-exiting end of the carton. All of these openings are preferably of the same size and configuration. These openings must be significantly less than the diameter D of the cans contained in the carton as illustrated by the height BT of the top end opening 72. The height BH of the bottom opening 74 on the exiting end 76 of the carton 76 is BH is preferably the same as BT.

While it is preferred that this carton have bottom opening 74 in the exiting end 76, it should be realized that this opening could be omitted. Top opening 78 and bottom opening 80 on the non-exiting end could also be omitted. It is preferred the carton have four openings 72, 74, 78 and 80 in order to save paperboard and display the labels and logos on the can to the consumer. It is preferred that there only be a dispenser in one end of the carton, but a dispenser could be provided in both ends. A carton embodying the features of this invention can be made to carry more cans than 12 by constructing it to carry four or more layers of cans of two or more cans in each layer.

The height DH of the fold line 64 and 66 from bottom flaps 12 and 26 is preferable from 110 to 150 percent of the diameter D of the can in order for the dispenser to operate conveniently. While the carton shown in FIG. 2 has two end flaps 34 and 44 on the exiting end 76 and 30 and 38 on the other end, it should be understood that each end could be constructed as a single panel.

As illustrated in FIGS. 2 and 3 the opening formed by curved end edges 67 and 68 and top opening 72 should be sufficient for a person's fingers to grasp the ends of a can and remove it resulting in tearing of zigzag tear lines 60 and 61 in the process and thus commencing opening the dispenser flap 55. If the openings formed by curved end edges 67 and 68 formed in bottom side panel 14 and top side panel 22 are of sufficient size and the paperboard is a lower strength, it may be feasible to construct the carton without top end opening 72 or make it much smaller than the diameter D of a can C that the carton is designed to hold. However, it is preferred that top end opening 72 be used and the distance BT between top edge 84 of exiting end flaps 34 and 44 and the edge 82 of top panel 18 not be too small, but significantly less than the diameter D of a can C.

Unique Features of the Dispenser and Carton of this Invention

One of the unique features of the dispenser of this invention is that it utilizes the can in the top layer of cans in the carton to be grasped and utilizes the leverage and mass provided by the can to start the tearing of the tear lines to form the dispenser flap. This carton is unique in that it has an opening at the top and bottom of both the exiting and non-exiting end of the carton. Zigzag tear lines with interruptions or lands in the riser and a tear or cut line in the step to allow the controlled tearing open of the dispenser flap are preferred.

While the invention has been disclosed in its preferred forms, it will be apparent to those skilled in the art that many modifications, additions, and deletions can be made therein without departing from the spirit and scope of the invention and its equivalents as set forth in the following claims.

What is claimed:

1. A blank for forming a carton, comprising:

a top panel;

a bottom side panel foldably connected to the top panel;

a top side panel foldably connected to the top panel;

at least one bottom flap;

at least one end flap extending along a first marginal area of the blank;

a first exiting end flap foldably connected to the bottom side panel and extending along a second marginal area of the blank; and a second exiting end flap foldably connected to the top side panel and extending along the second marginal area of the blank, wherein a side edge of the first exiting end flap extends to a first curved end edge of the bottom side panel, the first curved end edge extends concavely from the first exiting end flap to an exiting end edge of the top panel.

2. The blank of claim 1, wherein:

a side edge of the second exiting end flap extends to a first curved end edge of the top side panel; and the first curved end edge of the top side panel extends to the exiting end edge of the top panel.

3. The blank of claim 2, wherein the at least one end flap comprises:

a first end flap foldably connected to the bottom side panel; and a second end flap foldably connected to the top side panel.

4. The blank of claim 3, wherein the end edge of the top panel is free of flaps.

5. The blank of claim 1, wherein:

a side edge of the first end flap extends to a second curved end edge of the bottom side panel; and the second curved end edge of the bottom side panel extends to an end edge of the top panel.

6. The blank of claim 5, wherein:

a side edge of the second end flap extends to a second curved end edge of the top side panel; and the second curved end edge of the top side panel extends to the end edge of the top panel.

7. The blank of claim 6, wherein third and fourth curved end edges of the bottom side panel extend to the at least one bottom flap.

8. The blank of claim 6, wherein:

the at least one bottom flap comprises a first bottom flap foldably connected to the bottom side panel, and a second bottom flap foldably connected to the top side panel;

third and fourth curved end edges of the bottom side panel extend to the first bottom flap; and third and fourth curved end edges of the top side panel connect to the second bottom flap.

9. The blank of claim 1, wherein the first exiting end flap is foldably connected to the bottom side panel at two substantially parallel fold lines.

10. The blank of claim 9, wherein the first exiting end flap is foldably connected to the bottom side panel at two substantially parallel fold lines.

11. The blank of claim 1, wherein an exiting end edge of the top panel is free of flaps.

12. The blank of claim 1, wherein the exiting end edge of the top panel is free of flaps.

13. A method of enclosing containers within a carton, comprising:

providing a blank according to claim 1;

enclosing a plurality of containers within the blank; and adhering at least one flap of the blank so that the blank forms a substantially parallelepipedal structure, to form a carton wherein a corner of the carton at least partially defined by the first curved end edge of the bottom side panel and the exiting end edge of the top panel is open, and a container adjacent to the corner is accessible by hand through the open corner.

14. A blank for forming a carton, comprising:

a top panel;

a bottom side panel foldably connected to the top panel;

a top side panel foldably connected to the top panel;

at least one bottom flap;

at least one end flap extending along a first marginal area of the blank;

a first exiting end flap foldably connected to the bottom side panel and extending along a second marginal area of the blank;

a second exiting end flap foldably connected to the top side panel and extending along the second marginal area of the blank; and a first tear line extending through the first exiting end flap;

wherein a side edge of the first exiting end flap extends to a first curved end edge of the bottom side panel, the first curved end edge of the bottom side panel extends to an exiting end edge of the top panel.

15. The blank of claim 14, wherein the first tear line extends into the bottom side panel adjacent to the first curved end edge of the bottom side panel.

16. The blank of claim 15, further comprising a second tear line extending through the second exiting end flap and into the top side panel to a point adjacent to a first curved end edge of the top side panel.

17. A blank for forming a carton, comprising:

a top panel;

a bottom side panel foldably connected to the top panel;

a top side panel foldably connected to the top panel;

at least one bottom flap;

at least one end flap extending along a first marginal area of the blank;

a first exiting end flap foldably connected to the bottom side panel at substantially parallel fold lines and extending along a second marginal area of the blank;

a second exiting end flap foldably connected to the top side panel and extending along the second marginal area of the blank;

a first tear line extending through the first exiting end flap; and a second tear line extending through the second exiting end flap, wherein a side edge of the first exiting end flap extends to a first end edge of the bottom side panel, the first end edge of the bottom side panel extends to an exiting end edge of the top panel, a side edge of the second exiting end flap extends to a first end edge of the top side panel, and the first end edge of the top side panel extends to the exiting end edge of the top panel.

18. The blank of claim 17, wherein the at least one end flap comprises:

a first end flap foldably connected to the bottom side panel; and a second end flap foldably connected to the top side panel.

19. The blank of claim 18, wherein:

a side edge of the first end flap extends to a second end edge of the bottom side panel;

the second end edge of the bottom side panel extends to an end edge of the top panel;

a side edge of the second end flap extends to a second end edge of the top side panel; and the second end edge of the top side panel extends to the end edge of the top panel.

20. The blank of claim 19, wherein:

the at least one bottom flap comprises a first bottom flap foldably connected to the bottom side panel and a second bottom flap foldably connected to the top side panel;

third and fourth end edges of the bottom side panel extend to the first bottom flap; and third and fourth end edges of the top side panel extend to the second bottom flap.

21. The blank of claim 17, wherein:

the first tear line extends into the bottom side panel adjacent to the first end edge; and the second tear line extends into the top side panel.

22. The blank of claim 17, wherein the exiting end edge of the top panel is free of flaps.

23. A method of enclosing containers within a carton, comprising:

providing a blank according to claim 17;

enclosing a plurality of containers within the blank; and adhering at least one flap of the blank so that the blank forms a substantially parallelepipedal structure, wherein a first corner of the carton is at least partially defined by the first end edge of the bottom side panel, the first end edge of the top side panel, and the exiting end edge of the top panel, the first corner is open, and a container adjacent to the first corner is accessible by hand through the open first corner.

24. A blank for forming a carton, comprising:

a top panel;

a bottom side panel foldably connected to the top panel;

a top side panel foldably connected to the top panel;

at least one bottom flap;

at least one end flap extending along a first marginal area of the blank;

a first exiting end flap foldably connected to the bottom side panel and extending along a second marginal area of the blank; and a second exiting end flap foldably connected to the top side panel and extending along the second marginal area of the blank, a side edge of the first exiting end flap extends to a first curved end edge of the bottom side panel;

the first curved end edge of the bottom side panel extends concavely to an exiting end edge of the top panel;

a side edge of the second exiting end flap extends to a first curved end edge of the top side panel; and the first curved end edge of the top side panel extends concavely to the exiting end edge of the top panel wherein the exiting end edge of the top panel is free of flaps.

25. The blank of claim 24, wherein the at least one end flap comprises:

a first end flap foldably connected to the bottom side panel; and a second end flap foldably connected to the top side panel.

26. The blank of claim 25, wherein:

a side edge of the first end flap extends to a second curved end edge of the bottom side panel;

the second curved end edge of the bottom side panel extends to an end edge of the top panel;

a side edge of the second end flap extends to a second curved end edge of the top side panel; and the second curved end edge of the top side panel extends to the end edge of the top panel.

27. The blank of claim 26, wherein:

the at least one bottom flap comprises a first bottom flap foldably connected to the bottom side panel, and a second bottom flap foldably connected to the top side panel;

third and fourth curved end edges of the bottom side panel extend to the first bottom flap; and third and fourth curved end edges of the top side panel connect to the second bottom flap.

28. A method of enclosing containers within a carton, comprising:

providing a blank according to claim 24;

enclosing a plurality of containers within the blank; and adhering at least one flap of the blank so that the blank forms a substantially parallelepipedal structure, wherein at least one corner of the carton is open, and a container adjacent to the corner is accessible by hand through the open corner.

29. A blank for forming a carton, comprising:

a top panel;

a bottom side panel foldably connected to the top panel;

a top side panel foldably connected to the top panel;

at least one bottom flap;

at least one end flap extending along a first marginal area of the blank;

a first exiting end flap foldably connected to the bottom side panel and extending along a second marginal area of the blank;

a second exiting end flap foldably connected to the top side panel and extending along the second marginal area of the blank, a first tear line extending through the first exiting end flap; and a second tear line extending through the second exiting end flap wherein an exiting edge of the top panel is free of flaps.

30. A blank for forming a carton, comprising:

a top panel;

a bottom side panel foldably connected to the top panel;

a top side panel foldably connected to the top panel;

at least one bottom flap;

at least one end flap extending along a first marginal area of the blank;

a first exiting end flap foldably connected to the bottom side panel at substantially parallel fold lines and extending along a second marginal area of the blank;

a second exiting end flap foldably connected to the top side panel and extending along the second marginal area of the blank;

a first tear line extending through the first exiting end flap; and a second tear line extending through the second exiting end flap.

31. The blank of claim 30, wherein the at least one end flap comprises:

a first end flap foldably connected to the bottom side panel; and a second end flap foldably connected to the top side panel.

32. The blank of claim 31, wherein the first end flap is foldably connected to the bottom side panel at two substantially parallel fold lines.

33. The blank of claim 30, wherein an exiting end edge of the top panel is free of flaps.

34. The blank of claim 30, wherein:

a side edge of the first exiting end flap extends to a first curved end edge of the bottom side panel; and the first curved end edge of the bottom side panel extends to an exiting end edge of the top panel.

35. The blank of claim 34, wherein:

a side edge of the second exiting end flap extends to a first curved end edge of the top side panel; and the first curved end edge of the top side panel extends to the exiting end edge of the top panel.

36. The blank of claim 35, wherein:

a side edge of the first end flap extends to a second curved end edge of the bottom side panel;

the second curved end edge of the bottom side panel extends to an end edge of the top panel;

a side edge of the second end flap extends to a second curved end edge of the top side panel; and the second curved end edge of the top side panel extends to the end edge of the top panel.

37. The blank of claim 36, wherein the first tear line extends into the bottom side panel adjacent to the first curved end edge; and the second tear line extends into the top side panel adjacent the second curved end edge.

38. A method of enclosing containers within a carton, comprising:

providing a blank according to claim 30;

enclosing a plurality of containers within the blank; and adhering at least one flap of the blank so that the blank forms a substantially parallelepipedal structure, wherein the first and second exiting end flaps form an exiting end of the carton, and the parallel fold lines define a corner of the carton that is out of plane with the exiting end and out of plane with the bottom side panel.

* * * * *